US005613686A

United States Patent [19]

Yiu

[11] Patent Number: 5,613,686

[45] Date of Patent: Mar. 25, 1997

[54] TARGET BOARD HAVING A SURROUNDING DART RECEIVING CONFIGURATION

[76] Inventor: Chih-Hao Yiu, 7F-1, No. 30, Lin Sen Road, Taichung, Taiwan

[21] Appl. No.: 582,187

[22] Filed: Jan. 2, 1996

[51] Int. Cl.[6] ..... F41J 3/00

[52] U.S. Cl. ..... 273/408; 273/348.5

[58] Field of Search ..... 273/347, 408, 273/403, 404, 407

[56] References Cited

U.S. PATENT DOCUMENTS

| | | | |
|---|---|---|---|
| 3,894,736 | 7/1975 | Foley | 273/347 |
| 4,257,613 | 3/1981 | Straten | 273/347 |
| 5,290,041 | 3/1994 | Kettelson | 273/347 |

FOREIGN PATENT DOCUMENTS

| | | | |
|---|---|---|---|
| 1334767 | 7/1963 | France | 273/347 |
| 2044391 | 3/1972 | Germany | 273/347 |
| 2643228 | 3/1978 | Germany | 273/347 |
| 3900137 | 7/1990 | Germany | 273/408 |

*Primary Examiner*—Mark S. Graham
*Attorney, Agent, or Firm*—Charles E. Baxley, Esq.

[57] ABSTRACT

A target board includes a center target area and includes a number of cones formed in the surrounding portion. The cones each includes a tip formed in top and each includes a bottom of larger size. The bottoms of three or more cones are engaged with each other so as to define an opening for engaging with a dart. The openings are formed by three or more inwardly curved sides. A number of guide members are formed between every two adjacent cones and each includes a cusp formed in top and each includes two inclined surfaces for guiding the dart into the openings.

2 Claims, 3 Drawing Sheets

TARGET BOARD HAVING A SURROUNDING DART RECEIVING CONFIGURATION

BACKGROUND OF THE INVENTION

1. Field of the Invention

The present invention relates to a target board, and more particularly to a target board having a dart receiving configuration formed in the surrounding portion.

2. Description of the Prior Art

Typical target boards comprise a target portion formed in the center portion and a surrounding portion defined around the target portion. The target portion includes a number of target sections formed therein for engaging with and for holding the darts therein. Normally, the surrounding portion of the target board includes a plane configuration having no holes formed therein for receiving the darts such that the darts may rebound when hitting onto the surrounding portion of the target board. The darts normally include an elongated tip that may be easily damaged or broken after hitting the plane surrounding portion for several times.

The present invention has arisen to mitigate and/or obviate the afore-described disadvantages of the conventional target boards.

SUMMARY OF THE INVENTION

The primary objective of the present invention is to provide a target board which includes a surrounding portion having a number of openings therein for receiving and for holding the darts and for preventing the darts from being damaged.

In accordance with one aspect of the invention, there is provided a target board comprising a center portion having a plurality of target sections formed therein and comprising a surrounding portion. The surrounding portion includes a plurality of cones formed therein, the cones each includes a tip formed in top thereof and each includes a bottom of larger size, the bottoms of at least three cones are engaged with each other so as to define an opening therein for engaging with and for receiving a dart.

The bottoms of the cones each includes a circular peripheral portion, the circular peripheral portions of the cones define inwardly curved sides of the openings.

A plurality of guide members are provided between every two adjacent cones and each includes a cusp formed in top thereof and each includes two inclined surfaces for guiding the dart into the openings.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
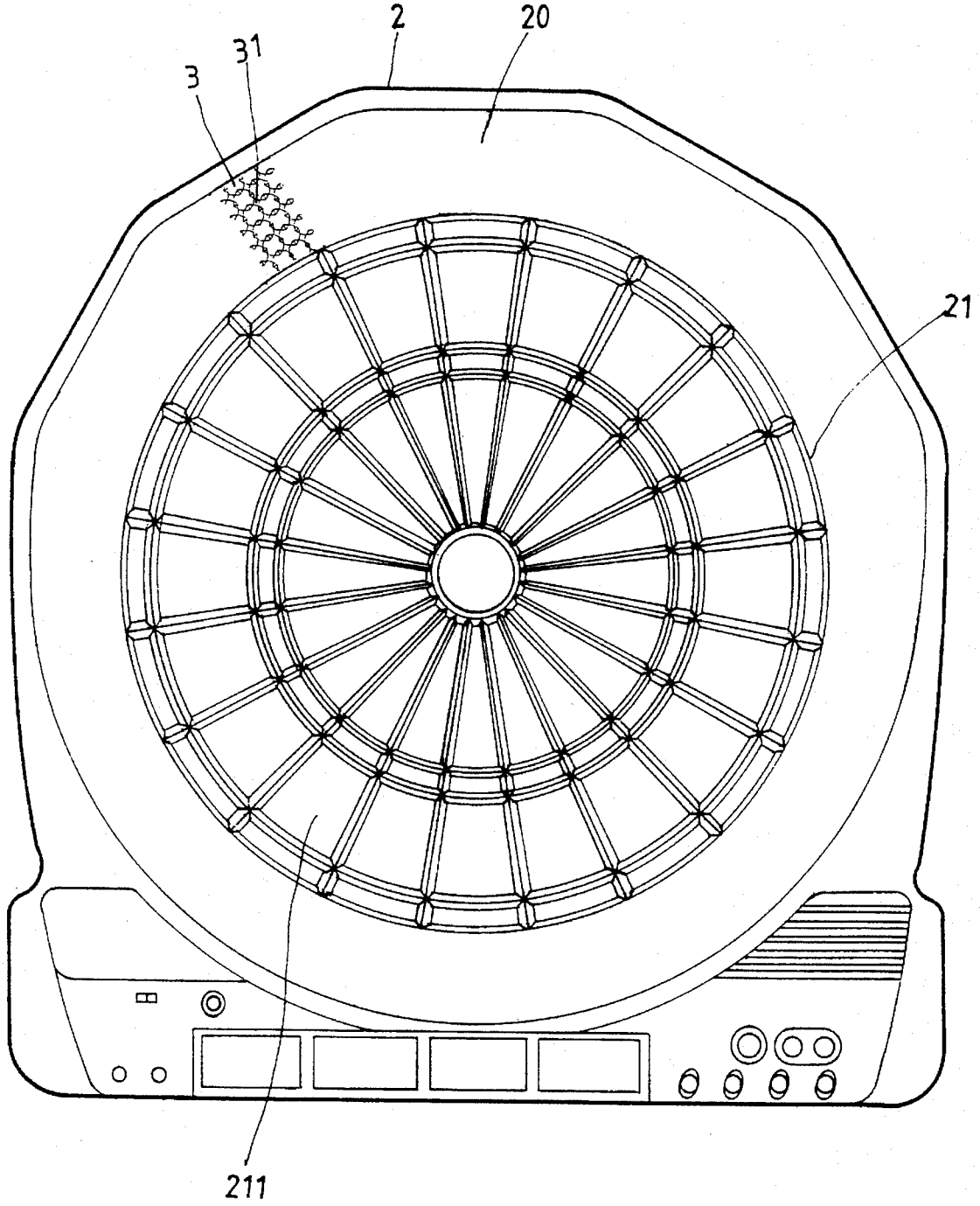
FIG. 1 is a front view of a target board in accordance with the present invention.

Referring to FIG. 1, a target board in accordance with the present invention is generally designated by a reference numeral "2" and comprises a number of target sections 211 formed in the center portion 21 for engaging with and for holding the darts therein; and comprises a surrounding portion 20.

Figure 2:
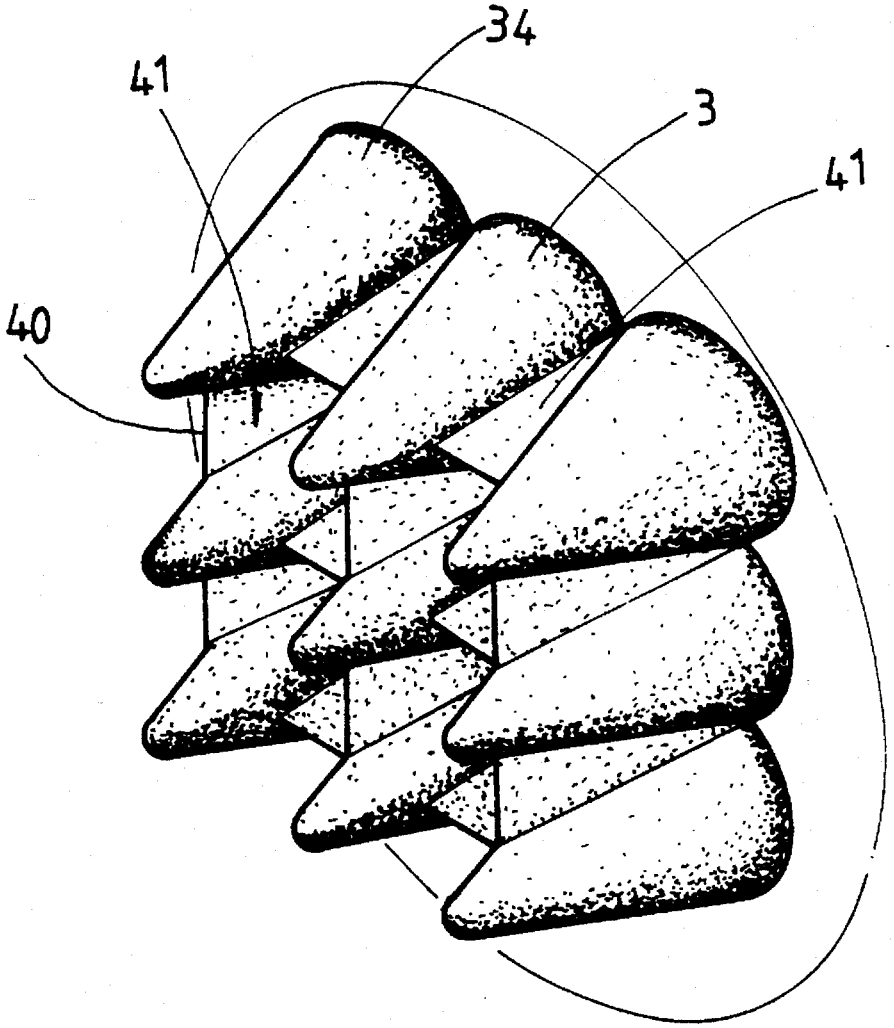
FIG. 2 is a partial perspective view of the dart receiving configuration formed in the surrounding portion of the target board.
Figure 3:
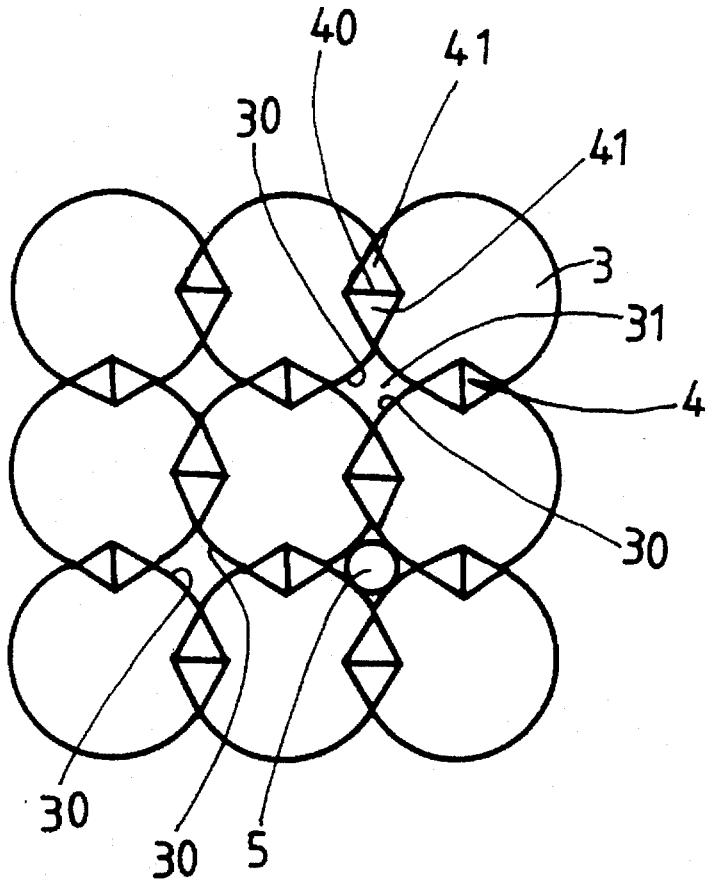
FIG. 3 is a top plane view of the dart receiving configuration of the surrounding portion, illustrating the operation of the dart receiving configuration of the surrounding portion.

Referring next to FIGS. 2 and 3, the surrounding portion 20 of the target board 2 includes a number of cones 3 formed therein. The cones 3 each includes a tip 33 formed in the top and each includes a bottom 34 of larger diameter. The bottoms 34 of the cones 3 each includes a circular peripheral portion 30. The bottoms 34 of three or more cones 3 are engaged with each other so as to define an opening 31 therein. The opening 31 includes a size slightly smaller than that of the tip 5 of the dart so as to engage with and to hold the tip 5 of the dart in place. It is to be noted that the bottom peripheral portions 30 of the cones 3 are circular or curved such that the opening 31 is formed by four inwardly curved sides 30; i.e., formed by the curved bottom peripheral portions 30 of the cones 3. It is further to be noted that the tip 5 is engaged with the inwardly curved sides 30 of the opening 31 in "point" contacts such that the curved bottom peripheral portions 30 of the cones 3 may "resiliently" hold the tip 5 in place.

A number of guide members 4 are provided between every two adjacent cones 3 and each includes a cusp 40 formed in the top and each includes two inclined side surfaces 41 for smoothly guiding the tip 5 into the openings 31.

Accordingly, the target board in accordance with the present invention includes a surrounding portion having a number of openings therein for receiving and for holding the darts and for preventing the darts from being damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A target board comprising a center portion having a plurality of target sections formed therein and comprising a surrounding portion, wherein said surrounding portion includes a plurality of cones formed therein, said cones each include including a tip formed in top thereof and each includes a bottom of larger size, said bottoms of at least three cones are engaged with each other so as to define an opening therein for engaging with and for receiving a dart, and said surrounding portion further includes a plurality of guide members provided between every two adjacent cones, said guide members each including a cusp formed in a top thereof and each includes two inclined surfaces for guiding the dart into said openings.

2. A target board according to claim 1, wherein said bottoms of said cones each includes a circular peripheral portion, said circular peripheral portions of said cones define inwardly curved sides of said openings.

* * * * *